United States Patent [19]

Tacchetto et al.

[11] Patent Number: 5,048,204

[45] Date of Patent: Sep. 17, 1991

[54] SECURING AND ADJUSTER DEVICE, PARTICULARLY FOR SKI BOOTS

[75] Inventors: Maurizio Tacchetto, Noventa Padovano; Claudio Zorzi, Silea; Giuseppe De Bortoli, Montebelluna; Alessandro Pozzobon, Paderno Di Ponzano Veneto; Renato Serafin, Vedelago, all of Italy

[73] Assignee: Nordica S.p.A., Montebelluna, Italy

[21] Appl. No.: 378,341

[22] Filed: Jul. 10, 1989

[30] Foreign Application Priority Data

Jul. 22, 1988 [IT] Italy ..... 82572 A/88
Jan. 20, 1989 [IT] Italy ..... 82503 A/88

[51] Int. Cl.[5] ..... A43C 11/00
[52] U.S. Cl. ..... 36/50; 36/119; 24/68 SK
[58] Field of Search ..... 36/117, 118, 119, 120, 36/121, 50; 24/68 SK

[56] References Cited

U.S. PATENT DOCUMENTS

| | | | |
|---|---|---|---|
| 4,644,670 | 2/1987 | Rochard et al. | 36/117 |
| 4,653,204 | 3/1987 | Morell et al. | 36/117 |
| 4,698,920 | 10/1987 | Benoit et al. | 36/117 X |
| 4,796,829 | 1/1989 | Pozzobon et al. | 36/119 X |
| 4,841,649 | 6/1989 | Baggio et al. | 36/117 |

FOREIGN PATENT DOCUMENTS

| | | | |
|---|---|---|---|
| 56953 | 1/1982 | European Pat. Off. . | |
| 132744 | 2/1985 | European Pat. Off. | 36/119 |
| 3644036 | 8/1988 | Fed. Rep. of Germany | 36/117 |

*Primary Examiner*—David T. Fidei
*Assistant Examiner*—Ted Kavanaugh
*Attorney, Agent, or Firm*—Guido Modiano; Albert Josif

[57] ABSTRACT

Securing and adjuster device for ski boots, composed of a circular winder, which is actuated by a knob and is connected for example to a foot presser, and of a vertical lever, which actuates a cable for closing the quarters; when the lever is opened, the winder is also released automatically; the adjustment of the two devices is independent.

8 Claims, 6 Drawing Sheets

SECURING AND ADJUSTER DEVICE, PARTICULARLY FOR SKI BOOTS

BACKGROUND OF THE INVENTION

The present invention relates to a securing and adjuster device, particularly for ski boots.

Various devices are currently known applied to ski boots for adjusting and securing traction elements for securing the foot inside the boot.

For this purpose, a French patent application is known (No. 82 20887 filed on 10.2.1982) which discloses a rear-entry ski boot with a closure lever connected to a single cable for simultaneously closing the quarters and securing the foot inside the boot.

Though said device has a single actuation element for closing and opening the quarters and for simultaneously releasing the foot instep, it does not allow to independently adjust said functions, forcing the skier to provide an adjustment which is a compromise between the obtainable optimum values.

A French patent is also known (No. 84 08599 filed on 5.18.1984) which discloses a securing device for a ski boot which has an additional element, constituted by a first lever, adapted to allow the skier to release a second lever which ensures the securing of the boot when it is closed.

This allows the skier to perform the opening action without having to bend down.

Said first lever, however, is an additional element pivoted to the boot, and in the closed position it protrudes from the boot profile and is therefore subject to possible accidental releases due to shocks for example.

As a partial solution to said disadvantages, the same Applicant filed on 7.23.1985 an application, No. 21669 A/85, which discloses a foot securing device with an automatic release unit which comprises a feeler which interacts with securing means, which engage a cable winding spool, and with the quarter when it is closed, said securing means disengaging from the spool when the quarter is opened.

This device, too, has disadvantages, however, since an accidental release can be caused due for example to the lack of pressure exerted at the feeler.

Said feeler furthermore constitutes an additional release element.

SUMMARY OF THE INVENTION

The aim of the present invention is therefore to eliminate the disadvantages described above in known devices by providing a device which allows, besides the independent adjustment of at least two distinct functions, such as for example the closure of the quarters and the securing of the foot inside the boot, also to automatically deactivate one function when the other is deactivated.

Within the scope of the above described aim, another important object is to provide a device which has very small dimensions.

Another important object is to provide a device which associates the preceding characteristics with that of being reliable and safe in use.

A further object is to provide a device which is furthermore free from accidental actuations.

This aim, these objects and others which will become apparent hereinafter are achieved by a securing and adjuster device, particularly for ski boots comprising at least one quarter and at least one foot securing device, characterized in that it comprises a first securing and adjusting element and a second securing and adjusting element acting independently on distinct regions of said ski boot, locking and release means being provided for said first element and being actuated by said second element.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 3:
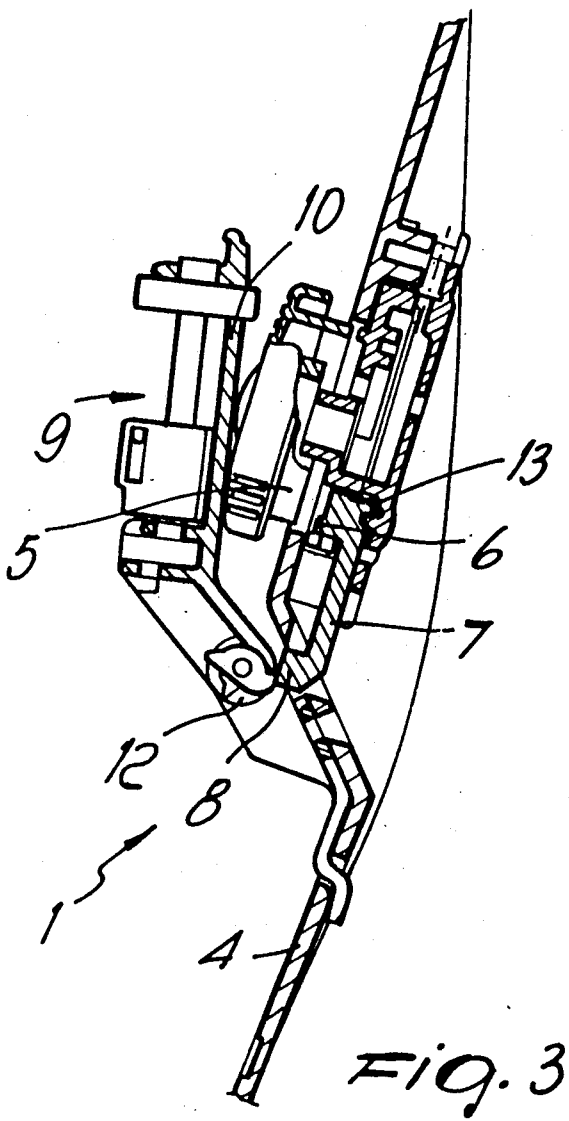
FIG. 3 is a view, similar to the preceding one, of the device in open position.
Figure 2:
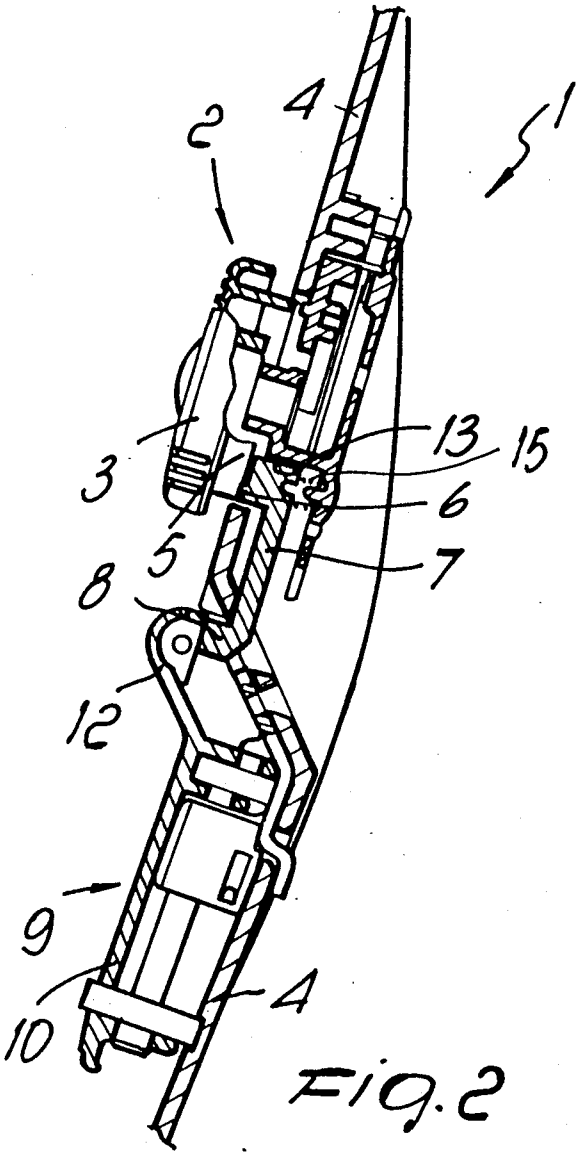
FIG. 2 is a partially sectional lateral schematic view of the device in closed position.
Figure 1:
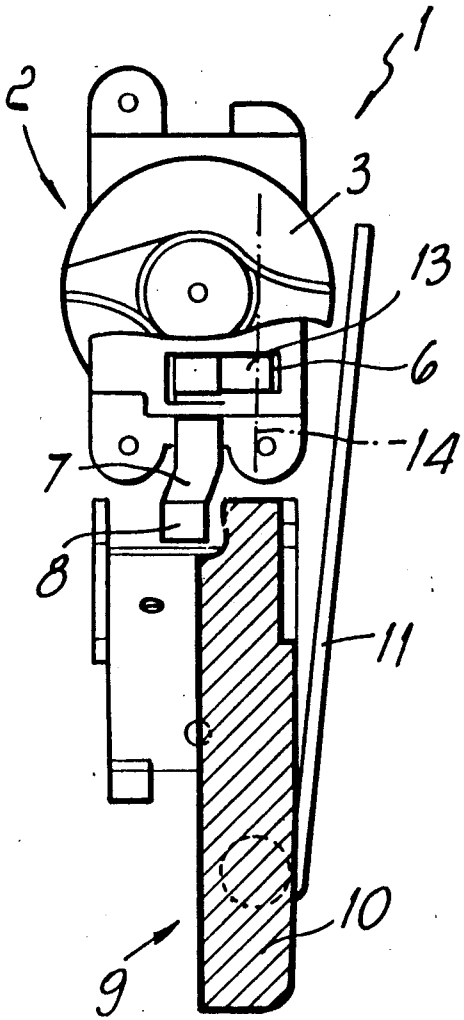
FIG. 1 is a partially sectional front view of the device in closed position.
Figure 4:
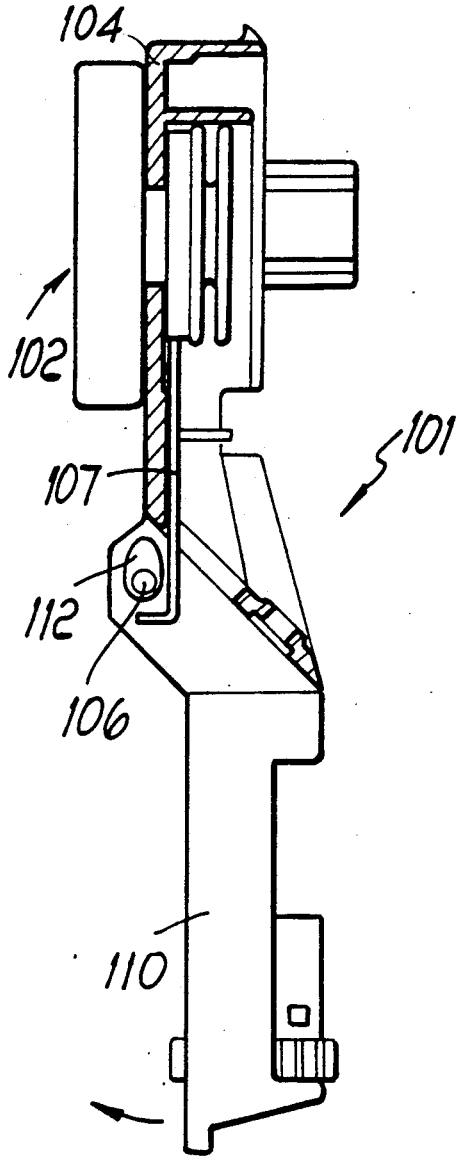
FIG. 4 is a partially sectional lateral elevation view of a device according to another aspect of the invention, in closed position.
Figure 5:
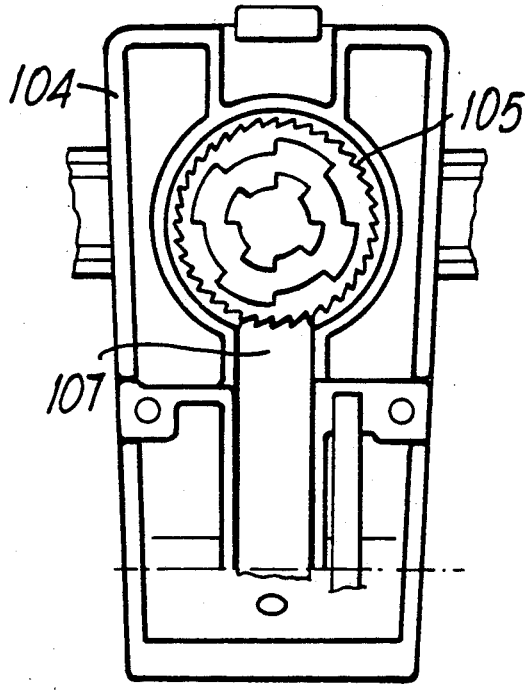
FIG. 5 is a partially sectional rear view of the device of FIG. 4.
Figure 6:
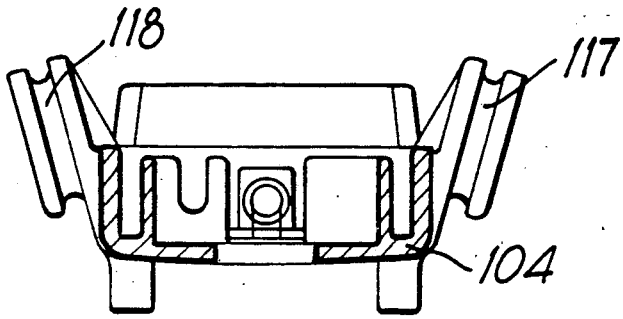
FIG. 6 is a partially sectional top view of the bracket of the device of FIGS. 4 and 5.
Figure 7:
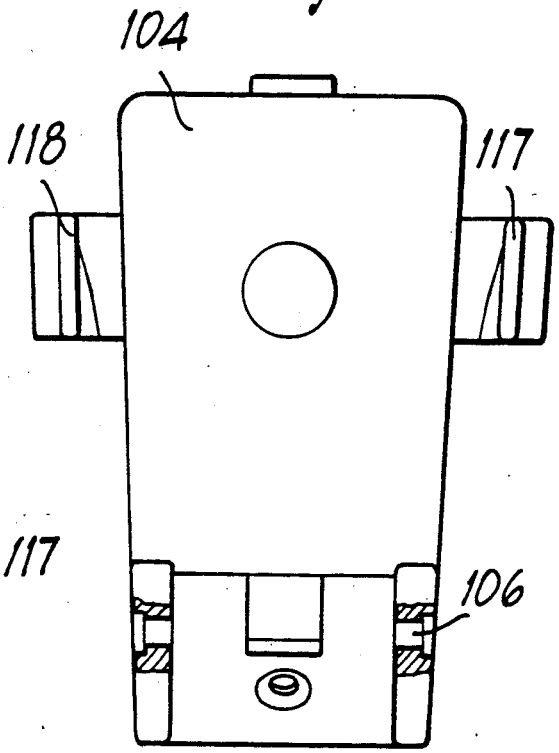
FIG. 7 is a front elevation view of the bracket of 5 FIG. 6.

With reference to FIGS. 1–3, the securing and adjuster device, generally indicated by the reference numeral 1, is constituted by a first device or first tensioning means 2, preferably constituted by a circular device for example of the kind described in the European Patent No. 0056953 of 11.21.1985 filed in the name of the same Applicant.

Said first device thus comprises a knob 3 which actuates an adapted winder which can define a first cable tensioning position for recovering a first cable or traction element and has a toothed crown 5 at the surface adjacent, for example, to the rear quarter 4 of a boot.

Said crown interacts ratchet-like with a complementarily shaped tooth 6 of a release element, constituted by a small rod 7 having an end 8 which protrudes outside the quarter 4; the actuation of said rod disengages the tooth 6 from the toothed crown 5 and allows to reverse the direction of rotation of the knob 3 to define a first cable release position and therefore to unwind the first traction element.

A second device or second tensioning means 9 is arranged adjacent to the first one 2; in the particular embodiment, said second device is arranged below the first one.

Said second device 9 is constituted by a vertical lever 10 pivoted transversely to the rear quarter 4 proximate to the terminal end 8 of the rod 7..

At least one second traction element, constituted by a second cable 11, is connected to said vertical lever 10 and is adapted for example to close the quarters of the boot by means of appropriate transmissions.

The end 12 of said vertical lever 10 which pivots to the rear quarter 4 is cam-shaped and, as illustrated in FIG. 2, interacts directly with the terminal end 8 of the rod 7 when the vertical lever 10 is closed i.e., in a second cable tensioning position, as no pressure is exerted by the end 12 at the end 8.

In this condition the tooth 6 therefore engages the toothed crown 5 of the knob 3.

If the vertical lever 10 is rotated and thus moved to its open condition i.e., a second cable release position, the cam-shaped end 12 of said lever exerts a pressure at the terminal end 8 of the rod 7, moving the tooth 6 to disengage from the toothed crown 5 of the knob 3.

The rod 7 is in fact pivoted at an axis indicated by 14 at an arm 13 which interacts with a bias spring 15.

FIGS. 4 to 7 illustrate a device 101 according to another aspect of the invention which is substantially similar to the previously described device 1 and is therefore provided with a circular device 102.

Said circular device 102 has a peripheral set of teeth 105, instead of a front one as in the preceding case, which is engaged by a pawl 107 which slides vertically to disengage the set of teeth 105 and is actuated by an eccentric element 112 rigidly associated with the lever 110 in a manner similar to the one described above.

A second peculiarity of the device 101 is that the circular device 102 comprises a supporting shell 104 which acts as a supporting bracket for the lever 110.

The shell 104 comprises a pin 106 for the pivoting of the lever 110 and advantageously comprises cable guiding elements 117, 118 actuated by said lever 110.

Figure 8:
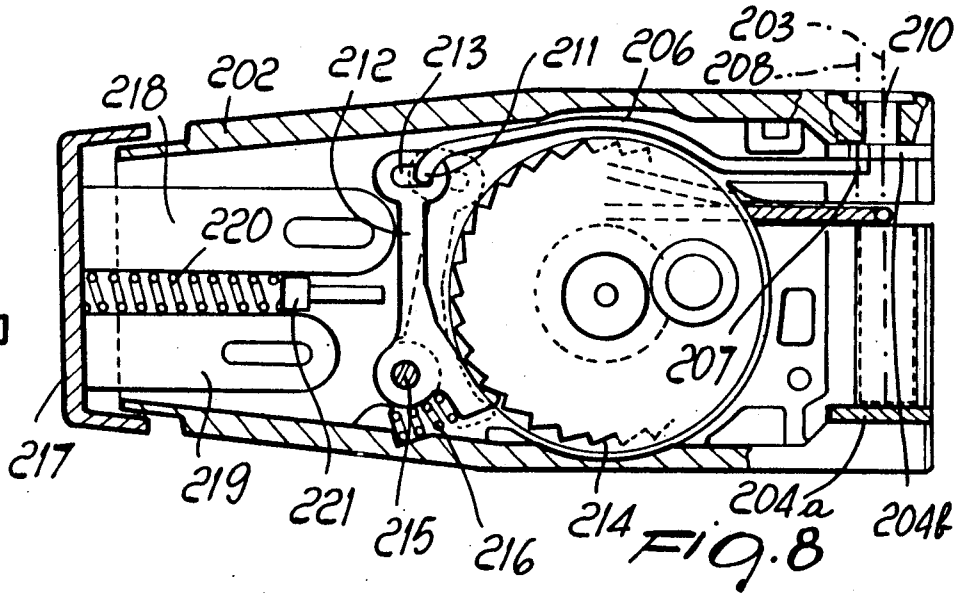
FIG. 8 is a partially sectional front view of the device according to a further aspect of the invention.
Figure 9:
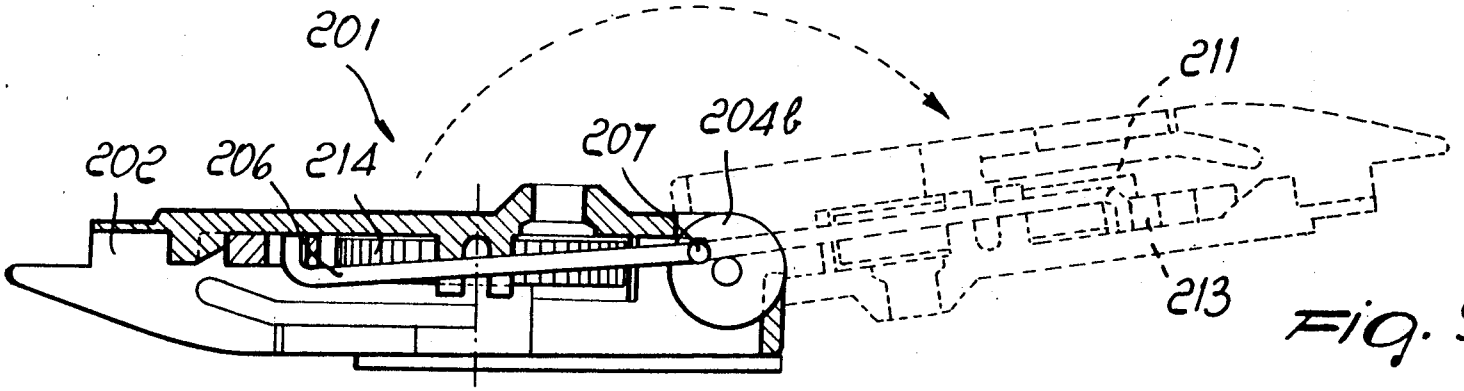
FIG. 9 is a partially sectional side view of the device of FIG. 8, illustrating the closed and open positions.
Figure 10:
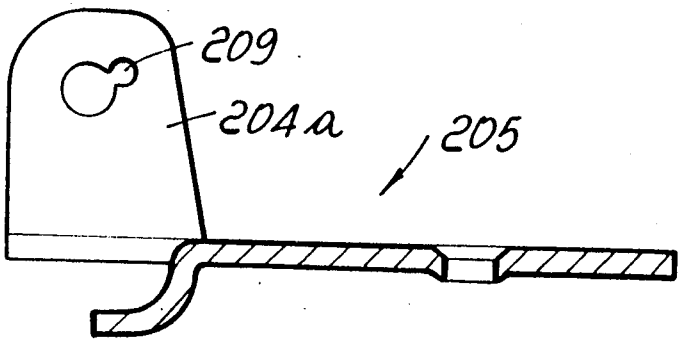
FIG. 10 is a partially sectional side view of the bracket of the device of FIGS. 8 and 9.

With reference to FIGS. 8 to 10, the securing and adjuster device, generally indicated by the reference numeral 201, is constituted by a lever 202 pivoted at one of its ends at an adapted first axis 203 which is transverse to the shoulders 204*a* and 204*b* of a bracket 205.

Said bracket is advantageously associated at a quarter of a ski boot.

The lever comprises means for closing the front and rear quarters of the boot, constituted for example by an adapted cable which is coupled, at its ends, laterally to the edges of the front quarter and interacts with the lever which tensions said cable during closure.

At least one winder is furthermore associated with the lever 202; said winder is constituted for example by a pulley for winding at least one traction element such as a cable which secures the foot inside the boot.

The device is constituted by an interconnection element 206 preferably constituted by an appropriately curved rigid rod which, at a first end 207, is adjacent to the corresponding end of the lever pivoted to the bracket 205, and is pivoted eccentrically to said shoulders 204 at a second axis 208 which is parallel to said first axis 203.

An adapted hole 209 is in fact provided on said shoulders and is approximately tangent to the corresponding hole used as seat for the first pivoting pin 210 of said lever 202.

The second end 211 of said interconnection element 206 is also curved so as to couple to a pawl 212 at an adapted eyelet 213 provided at one end thereof.

Said pawl 212 is arranged between the free end of the lever 202 and said winder and approximately transversely to said lever; its other end interacts ratchet-like with an adapted toothed wheel 214 rigidly rotationally associated with said winder.

The pawl 212 can be actuated since it is pivoted to the lever 202 at a second pivot 215 arranged approximately opposite to said slot 213.

The end of said pawl which interacts ratchet-like with said toothed wheel 214 advantageously interacts on the opposite side with a preset elastically deformable means such as a spring 216 adapted to force the pawl to engage one of the teeth of said wheel when the lever 202 is closed.

In this condition, in which the winder's rotary motion in one direction is prevented, the second end 211 of the interconnection element 206 abuts at the inner lateral surface of the slot 213.

The use of the device is as follows: in the condition illustrated in FIG. 8, with the lever closed and therefore for example after closing the boot's quarters, the skier may preset the degree of securing for example of the foot inside the boot by gripping the adapted accessible knob which rotates the winder.

This position is kept by virtue of the presence of the pawl 212 which interacts ratchet-like with the toothed wheel 214.

If the skier has stopped skiing or in any case wishes to open the quarters and release the foot inside the boot, it is sufficient for him to rotate the lever 202 through approximately 180 degrees, moving it to an open position.

In this manner, on one hand he slackens for example the preset cable used to close the quarters, and on the other, by virtue of the eccentric pivoting of the interconnection element 206 to the pivot 210, actuates the pawl 212 so as to move it to disengage from the teeth of the toothed wheel 214.

Because of the rigidity of the interconnection element 206, an equal rotation imparted by the lever corresponds to a traction exerted at the end of the pawl which has the slot 213, the second axis 208 being arranged parallel to the first axis 203 toward the free end of the lever 202.

In this manner the preset cable, used for example to secure the foot and wound at the winder, is released subsequent to the opening of the quarters, thus automatically releasing the foot.

The device 201 is furthermore advantageously provided with means adapted to disengage the pawl 212 from the toothed wheel 214 when the lever is closed.

Said means comprise a button 217 which has a tab 218 which acts on the pawl 212 when the button is pressed upwards. The pawl 212 rotates on the second pivot 215 releasing the toothed wheel 214 as described above.

The button 217 furthermore comprises a second guiding tab 219 and a return spring 220 which acts in abutment against the locator element 221.

It has thus been observed that the invention achieves the intended aim and objects, a securing and adjuster device having been obtained which allows to simultaneously adjust two separate functions such as the closure of the quarters and the securing of the foot inside the boot and to automatically deactivate one function, such as for example the securing of the foot, when the other one is deactivated.

Besides being reliable and safe in use by virtue of the use of a rigid interconnection element, the device thus obtained furthermore has modest dimensions and costs.

The operative safety of the device is furthermore due to the fact that when the lever is closed the accidental uncoupling of the pawl 212 from the toothed wheel 214 is not possible.

FIGS. 11–15 illustrate a device 301 according to a further aspect of the invention, which comprises, also in this case, a circular device 302 for example of the kind described in the European patent No. 0056953 in the name of the same Applicant.

The device 301 comprises a lever 311 pivoted about an axis 306 to a supporting bracket 305 which is only partially illustrated.

Said circular device 302 comprises a pulley 309 actuated by a ring 308 which in turn comprises a front set of teeth 308*a* and naturally an actuation knob 313.

A pawl 303 is pivoted to a shaft 307 and has a tooth 303*a* and a tab 303*b* adapted to interact with a pivot 304 rigidly associated with the bracket 305.

The lever 311 acts for example on one or more cables (not illustrated in the figures) for closing the quarter, while the pulley 309 winds a cable 312 which is advantageously guided by a flexible sheath 310 which makes the adjustment independent from the movement of the lever.

As an alternative, the cable 312 can be passed through the region of the lever's fulcrum so that the movement thereof does not alter the adjustment of the length of the cable, avoiding the use of a sheath.

The operation of the device 301 is as follows.

Figure 11:
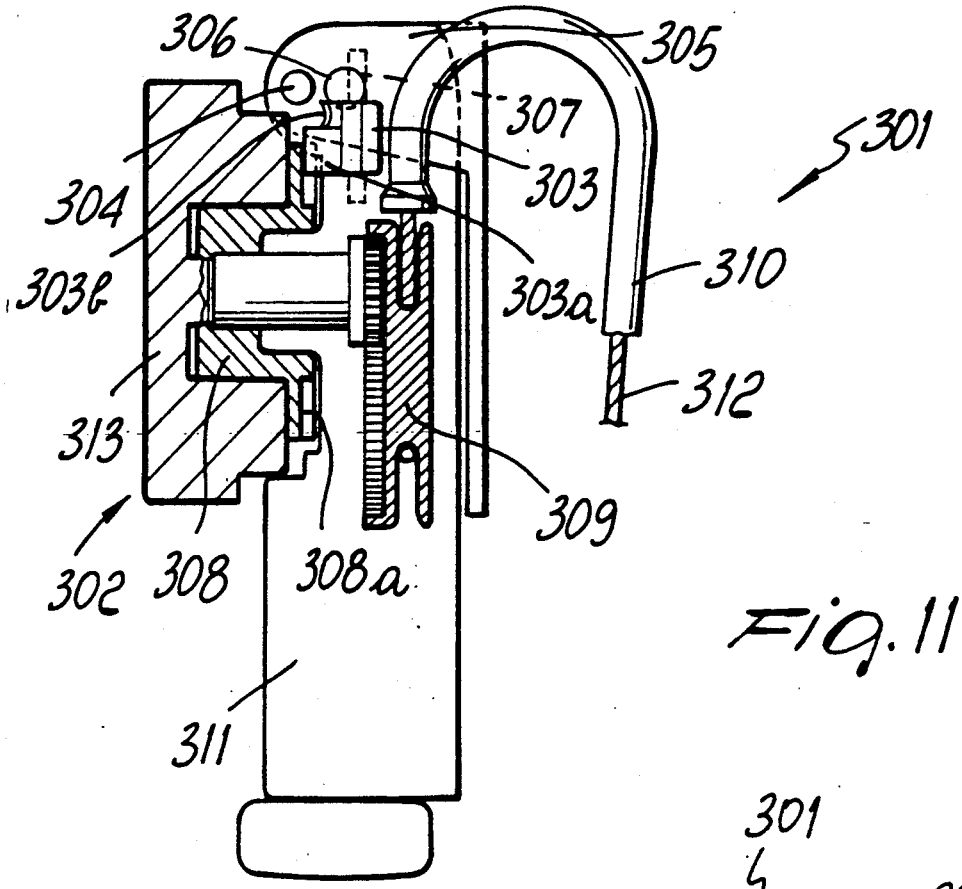
FIGS. 11, 12 and 13 are partially sectional side views of a device according to another aspect of the invention, respectively in closed, partially open and fully open position.

FIG. 11 illustrates the closed position of the lever 311 in which the pawl 303 is in such a position that the tooth 303*a* engages the set of teeth 308*a*, preventing the rotation of the pulley 309.

Figure 12:
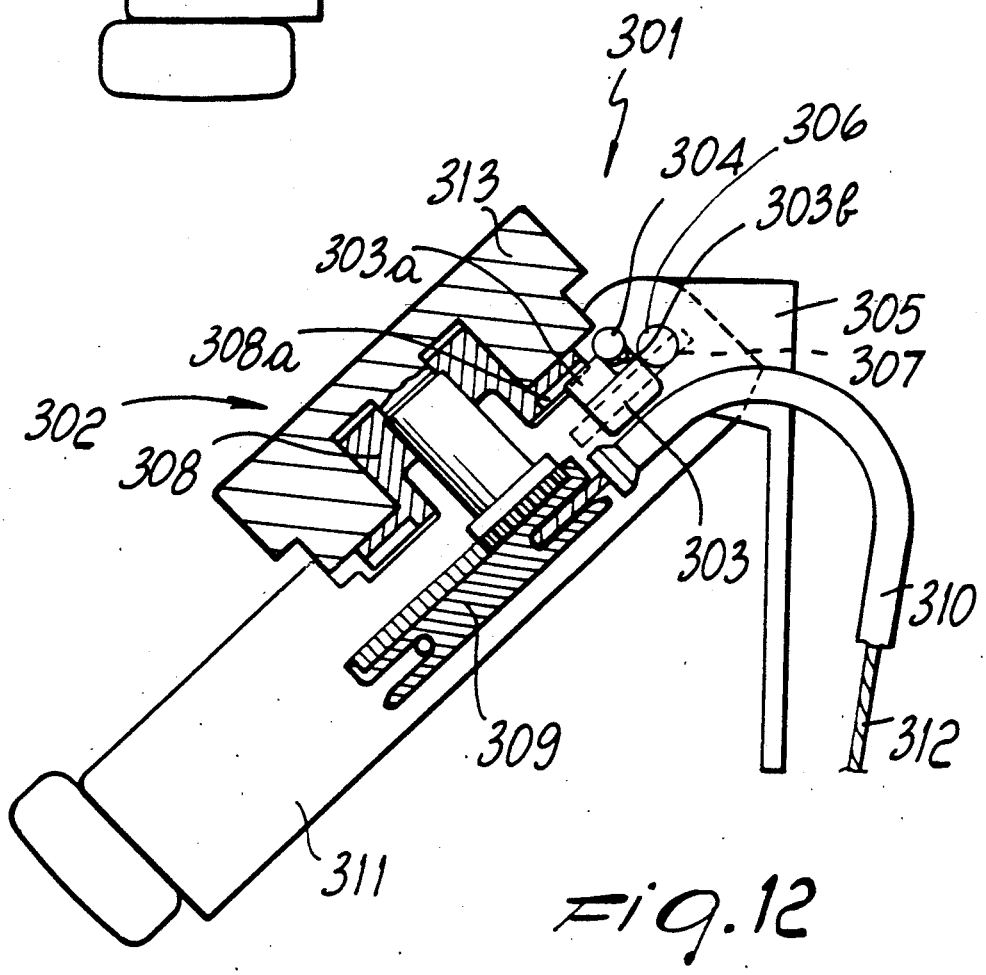
Figure 13:
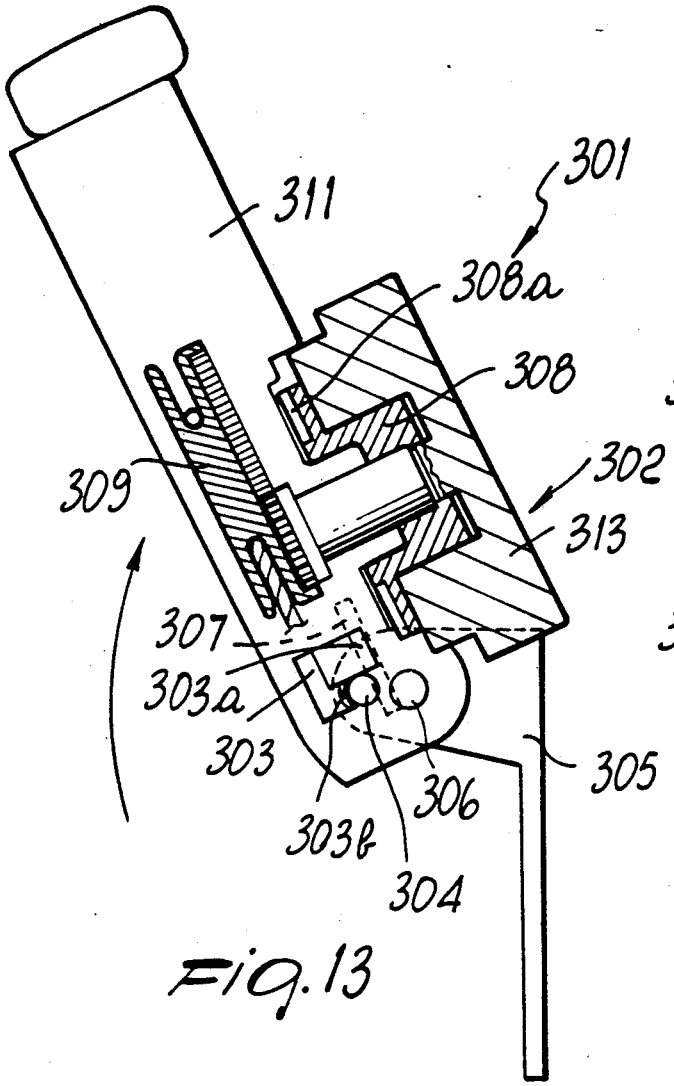

With reference to FIG. 12, by rotating clockwise the lever 311, the tab 303*b* of the ratchet 303 is moved to abut against the pivot 304, and (FIG. 13) the further rotation of the lever rotates the pawl 303 on its axis 307, disengaging the tooth 303*a* from the set of teeth 308*a*.

The pivot 304 prevents the pawl 307 from rotating rigidly with the lever.

When the lever 311 is turned over completely (FIG. 13), the pawl 303 is completely disengaged, leaving the cable free to unwind from the pulley.

Figure 15:
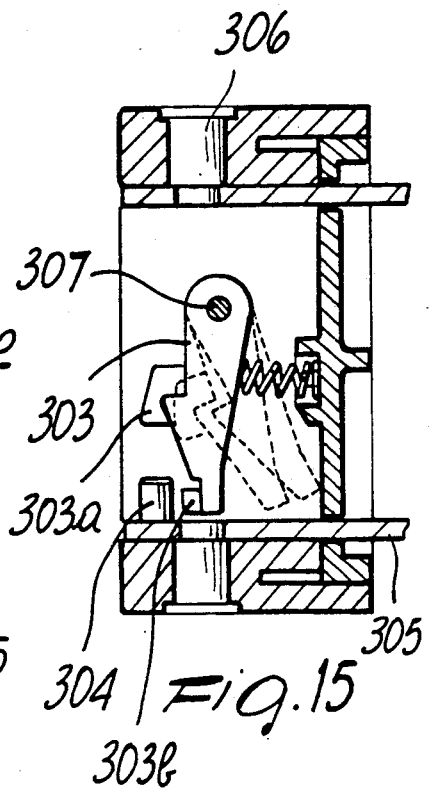
FIG. 15 is a partially sectional top view of a detail of FIGS. 11–13.
Figure 14:
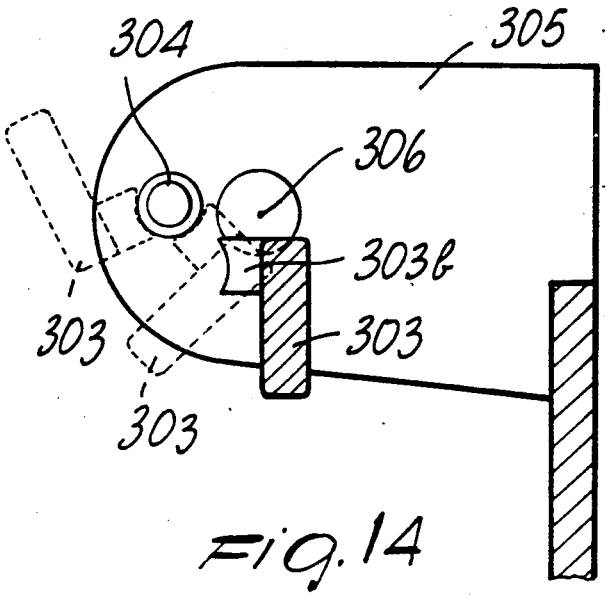
FIG. 14 is an enlarged lateral elevation detail view of the pivoting of the device of FIGS. 11–13.
Figure 16:
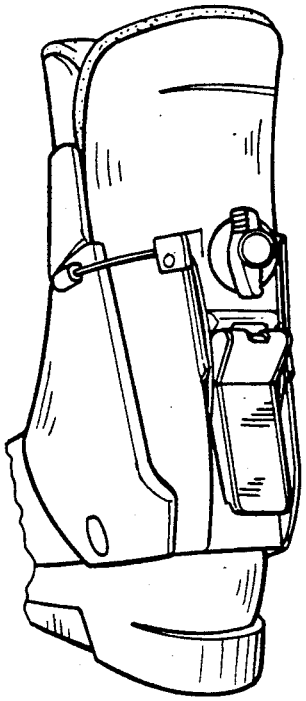
FIG. 16 is a schematic rear perspective view of a ski boot with a device similar to that of FIGS. 1–3, 17, 18.

FIGS. 14 and 15 illustrate in detail the movement of the pawl with respect to the supporting bracket 305 during the rotation of the lever 311.

Figure 17:
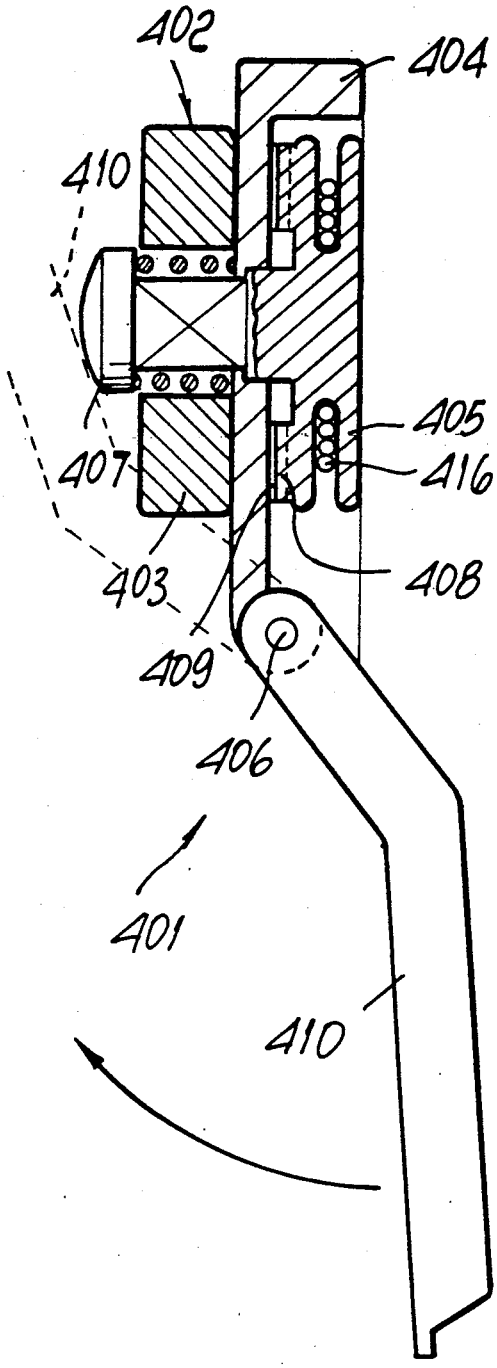
FIG. 17 is a partially sectional side view of a device in closed position according to yet a further aspect of the invention.
Figure 18:
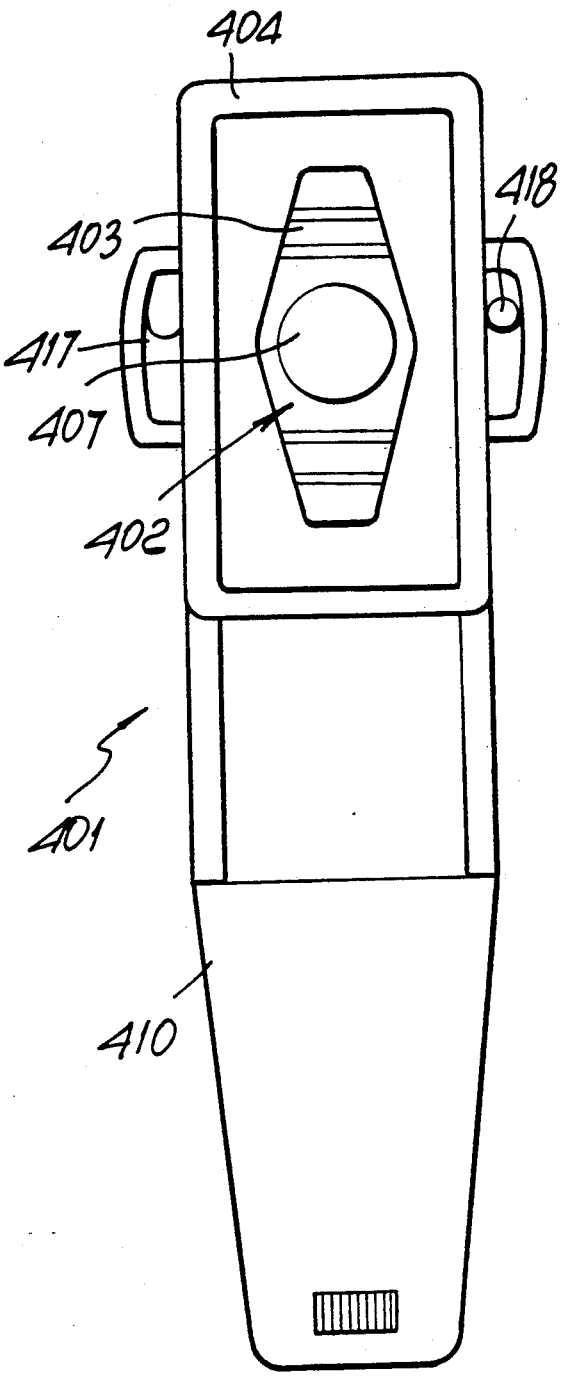
FIG. 18 is a front view of the device of FIG. 17 in closed position.

FIGS. 17 and 18 illustrate a device according to yet a further aspect of the invention and generally indicated by the numeral 401.

Similarly to the devices described above, the device 401 comprises a lever 410 hinged at a supporting shell 404 by means of pivot 406.

The supporting shell 404 has cable guiding elements 417,418 and supports a circular device 402.

The circular device 402 has a knob 404 operating a pulley 405 adapted to wind a cable 416.

The pulley 405 is connected to a push button 407 slideable in said knob 404 and protruding externally.

The pulley 405 has frontal saw teeth 408 cooperating with analogous frontal saw teeth 409 associated with shell 404.

A spring 410 biases the pulley's teeth 408 to engage teeth 409 in order to prevent any rotation of pulley 405 in the unwinding direction and, at the same time, to allow a ratchet-like motion of the pulley when winding the cable.

As said above, the push button 407 can slide in the knob 403 and is connected to pulley 405; in this manner to disengage the pulley 405 from the teeth 409 for unwinding the cable 416, it is sufficient to push the button 407. This can be done by opening the lever 410, i.e. rotating it in the direction of the arrow as by FIG. 17.

Naturally the push button 407 is slideable in knob 403 but cannot rotate therewith.

The device is naturally susceptible to numerous modifications and variations, all of which are within the scope of the inventive concept.

We claim:

1. Securing and adjustment device particularly for ski boots, comprising;

first tensioning means defining at least a first cable tensioning position and a first cable release position.

at least one first cable connected to said first tensioning means, locking means releasably engaging said first tensioning means for locking said first tensioning means in said first cable tensioning position.

second tensioning means defining at least a second cable tensioning position and a second cable release position, at least one second cable connected to said second tensioning means, and release means for converting movement of said second tensioning means into movement of said locking means, wherein said release means disengage said locking means from said first tensioning means upon moving said second tensioning means to said second cable release position, thereby simultaneously causing said first tensioning means to assume said first cable release position.

wherein said first tensioning means comprise at least one cable winding device, said cable winding device having at least one toothed crown, said second tensioning means comprising at least one lever, said locking means comprising at least one tooth, said tooth releasably engaging said toothed crown said release means comprising at least one rod, said rod being connected to said tooth, said lever being engageable with said rod for disengaging said tooth from said toothed crown.

2. Securing and adjustment device according to claim 1, wherein said first tensioning means comprise at least one cable winding device, said cable winding device having at least one toothed crown, said second tensioning means comprising at least one lever; said locking means comprising at least one tooth, said tooth releasably engaging said toothed crown, said release means comprising at least one rod, said rod being connected to said tooth, said lever having defined thereon at least on cam, said cam being second cable release position for disengaging said tooth from said toothed crown.

3. Securing and adjustment device according to claim 1, wherein said second tensioning means comprises lever means and cam means, said cam means engaging said release means upon moving said second tensioning means to said second cable release position.

4. Securing and adjustment device according to claim 2, wherein said rod is pivotally connected to said lever at a rod pivot axis, said device further comprising biasing means, said rod having at least one arm, said biasing means acting on said arm, said cam engaging and moving said rod against said biasing means upon moving said lever to said second cable release position for disengaging said tooth from said toothed crown.

5. Securing and adjustment device particularly for ski boots, comprising;

first tensioning means defining at least a first cable tensioning position and a first cable release position, at least one first cable connected to said first tensioning means, locking means releasably engaging said first tensioning means for locking said first tensioning means in said first cable tensioning position, second tensioning means defining at least a second cable tensioning position and a second cable release position, at least one second cable connected to said second tensioning means; and release means interposed between said locking means and said second tensioning means, wherein said release means cooperate with said locking means and disengage said locking means from said first tensioning means upon moving said second tensioning means to said second cable release position, thereby simultaneously causing said first tensioning means to assume said first cable release position, and wherein said first tensioning means are rotatably connected to said second tensioning means, said first tensioning means being rotatable about an axis, said axis being stationary with respect to said second tensioning means, wherein said first tensioning means comprise at least one cable winding device, said cable winding device having at least one toothed crown, said second tensioning means comprising at least one lever, said locking means comprising at least one tooth, said tooth releasably engaging said toothed crown, said release means comprising at least one rod, said rod being connected to said tooth, said lever being engageable with said rod fir disengaging said tooth from said toothed crown.

6. Securing and adjustment device according to claim 5, wherein said first tensioning means comprise at least one cable winding device, said cable winding device having at least one toothed crown, said second tensioning means comprising at least one lever, said locking means comprising at least one tooth, said tooth releasably engaging said toothed crown, said release means comprising at least one rod, said rod being connected to said tooth, said lever having defined thereon at least one cam, said cam being engageable with said rod upon moving said lever to said second cable release position for disengaging said tooth from said toothed crown.

7. Securing and adjustment device according to claim 5, wherein said second tensioning means comprises lever means and cam means, said cam means engaging said release means upon moving said second tensioning means to said second cable release position.

8. Securing and adjustment device according to claim 6, wherein said rod is pivotally connected to said lever at a rod pivot axis, said device further comprising biasing means, said rod having at least one arm, said biasing means acting on said arm, said cam engaging and moving said rod against said biasing means upon moving said lever to said second cable release position for disengaging said tooth from said toothed crown.

* * * * *